United States Patent [19]

Nagatani

[11] Patent Number: 4,509,422

[45] Date of Patent: Apr. 9, 1985

[54] PAPER DISCHARGER IN CYLINDER SCREEN PRINTING MACHINE

[75] Inventor: Kazuo Nagatani, Seki, Japan

[73] Assignee: Sakurai Machine Trading Co., Ltd., Tokyo, Japan

[21] Appl. No.: 541,146

[22] Filed: Oct. 12, 1983

Related U.S. Application Data

[63] Continuation-in-part of Ser. No. 391,551, Jun. 24, 1982, Pat. No. 4,448,124.

[30] Foreign Application Priority Data

Jun. 10, 1983 [JP] Japan ..... 58-104741

[51] Int. Cl.[3] ..... B41L 13/00

[52] U.S. Cl. ..... 101/118

[58] Field of Search ..... 101/117, 118, 123, 125; 198/632

[56] References Cited

U.S. PATENT DOCUMENTS

| | | | |
|---|---|---|---|
| 985,872 | 3/1911 | Whiting | 198/632 |
| 997,868 | 7/1911 | Steele | 198/632 |
| 1,110,419 | 9/1914 | Carpenter | 198/632 |
| 1,198,701 | 9/1916 | Comer | 198/632 |
| 2,462,447 | 2/1949 | Wellborn | 101/123 |
| 4,176,601 | 12/1979 | Szarua | 101/110 X |
| 4,182,433 | 1/1980 | Foster | 198/632 |
| 4,193,344 | 3/1980 | Ericsson | 101/123 |
| 4,210,077 | 7/1980 | Lindstrom | 101/123 X |
| 4,245,554 | 1/1981 | Kammann et al. | 101/123 X |
| 4,352,326 | 10/1982 | Kammann | 101/123 |

*Primary Examiner*—E. H. Eickholt

*Attorney, Agent, or Firm*—Leydig, Voit, Osann, Mayer & Holt, Ltd.

[57] ABSTRACT

A cylinder screen printing machine comprises a cylinder rotatable about its own axis in opposite directions, a screen plate disposed upwardly of the cylinder and movable reciprocably in synchronism with rotation of the cylinder, a squeezee positioned upwardly of the screen plate for pressing ink through the screen plate onto a sheet of printing paper passing between the cylinder and the screen plate in response to synchronized movements of the cylinder and the screen plate, a paper discharge table located between spaced frames and downstream of the cylinder for discharging a printed sheet which has been fed from the cylinder, the paper discharge table being retractable downwardly from an upper position to provide a space below the screen plate, first means for supporting the paper discharge table in the upper position, the first means being operable to allow the paper discharge table to be retracted downwardly, and second means for positioning a rear end of the paper discharge table vertically and laterally in the upper position with respect to the pair of frames.

10 Claims, 16 Drawing Figures

PAPER DISCHARGER IN CYLINDER SCREEN PRINTING MACHINE

CROSS REFERENCE TO RELATED APPLICATION

This application is a continuation-in-part of my copending U.S. patent application Ser. No. 391,551, filed June 24, 1982 now U.S. Pat. No. 4,448,124 for "Apparatus for Discharge of Printed Sheets from a Cylinder Type Screen Printing Machine."

BACKGROUND OF THE INVENTION

1. Field of the Invention

The present invention relates to a cylinder screen printing machine, and more particularly to a paper discharger in such a printing machine, capable of easily cleaning the underside of a screen plate and easily removing any dirt from the peripheral surface of a cylinder.

2. Description of the Prior Art

FIG. 1 of the accompanying drawings schematically shows a conventional cylinder screen printing machine. One of stacked sheets of printing paper 101 is fed by a paper feed belt 2 from an automatic paper feeder 1 to a cylinder 3. The sheet of printing paper 101 is positioned immediately in front of the cylinder 3 as shown in FIG. 2. The paper feeding and positioning device are omitted from illustration as it has no bearing on the present invention.

The cylinder 3 is rotated about its own axis in the direction of the arrow 102 or in the opposite direction by a sector gear 7 angularly movable back and forth by a crank 5 through a connecting rod 6 and a gear 8 attached to one end of the cylinder 3 and held in mesh with the sector gear 7. A screen plate 9 disposed upwardly of the cylinder 3 is reciprocably moved to and fro in the directions of the arrows 103, 104 by a reciprocating mechanism (not shown) in synchronism with the back-and-forth angularly movement of the cylinder 3.

In synchronism with the movement of the screen plate 9 in the direction of the arrow 103, the cylinder 3 is angularly moved about its own axis in the direction opposite to the arrow 102 to the position shown in FIG. 2. After a leading edge of the sheet of printing paper 101 is gripped by a paper gripper 4 attached to the cylinder 3, the cylinder 3 is rotated back in the direction of the arrow 102. At this time, a squeegee 10 is lowered toward the screen plate 9 at a position where the paper gripper 4 passes, to press the screen plate 9 as it moves in the direction of the arrow 104 for thereby squeezing ink down through the screen plate 9. The pattern on the screen plate 9 is thus printed on the sheet of printing paper 101 fed below the screen plate 9.

When the paper gripper 4 is opened in front of a paper guide 11 as shown by the phantom line in FIG. 2 after the cylinder 3 has rotated in the direction of the arrow 102, the sheet of printing paper 101 is allowed to move over the paper guide 11 as shown in FIG. 3 onto a paper discharge table 12 positioned downstream of the cylinder 3. The cylinder 3 is then rotated back after it has been rotated in the direction of the arrow 102 to the position illustrated in FIG. 3, and simultaneously the screen plate 9 is moved back in the direction of the arrow 103 after it has been moved in the direction of the arrow 104 to the position of FIG. 3. As the screen plate 9 is moved back in the direction of the arrow 103, the squeegee 10 is lifted and a doctor blade 103 is lowered to spread a uniform coat of ink over the screen plate 9.

Thereafter, the cylinder 3 is rotated again in the direction opposite to the arrow 102 to repeat the foregoing cycle of operation for printing.

With the prior arrangement as described above, the underside of the screen plate 9 is cleaned and any dirt on the peripheral surface of the cylinder 3 is removed either directly by hand inserted from a rear position into a space below the screen plate 9 or by an instrument in a process which takes a long period of time. When the screen plate 9 is positioned as shown in FIGS. 2 and 3, a space 105 between the screen plate 9 and the paper feed belt 2 and a space 106 between the screen plate 9 and the paper discharge table 12 are relatively small, rendering the cleaning procedure awkward and preventing the screen plate 9 and the cylinder 3 from being cleaned sufficiently. It has eventually been necessary to remove the screen plate 9 for cleaning the same and the cylinder 3.

When the screen plate 9 is to be attached again, its positioning and color registration at the time of printing have to be readjusted, a procedure which shortens the time required for printing and reduces the printing efficiency.

One way for an easy cleaning process is to enlarge the spaces 105, 106 below the screen plate 9. To this end, the paper feed belt 2 or the paper discharge table 12 may be lowered away from the screen plate 9. However, since the retraction of the paper feed belt 2 would cause interference with other components, it would be preferable to retract the paper discharge table 12 downwardly.

As shown in FIGS. 1 through 3, lateral frames are interconnected by a shaft stay 17 attached to rear ends thereof. The shaft stay 17 is positioned downwardly of the screen plate 9 and becomes an obstacle to the operation for cleaning the screen plate 9 and the cylinder 3. It is therefore desirable to remove the shaft stay 17 for facilitating the cleaning operation.

SUMMARY OF THE INVENTION

Accordingly, it is an object of the present invention to provide a paper discharger in cylinder screen printing machines which includes a paper discharge table retractable downwardly and dispenses with a shaft stay interconnecting lateral printing machine frames for allowing the underside of a screen plate and the peripheral surface of a cylinder to be easily accessed for cleaning or dirt removal.

Another object of the present invention is to provide a paper discharger in cylinder screen printing machines which has a downwardly retractable paper discharge table that can securely be fixed between lateral machine frames in a horizontal position while accurately positioning the rear end of the paper discharge table laterally and vertically.

According to the present invention, there is provided a cylinder screen printing machine comprising a cylinder rotatable about its own axis in opposite directions, a screen plate disposed upwardly of the cylinder and movable reciprocably in synchronism with rotation of the cylinder, a squeezee positioned upwardly of the screen plate for pressing ink through the screen plate onto a sheet of printing paper passing between the cylinder and the screen plate in response to synchronized movements of the cylinder and the screen plate, a paper discharge table located between spaced frames and downstream of the cylinder for discharging a printed sheet which has been fed from the cylinder, the paper discharge table being retractable downwardly from an upper position to provide a space below the screen plate, first means for supporting the paper discharge table in the upper position, the first means being operable to allow the paper discharge table to be retracted downwardly, and second means for positioning a rear end of the paper discharge table vertically and laterally in the upper position with respect to the pair of frames. The first means includes clamp boxes mounted on the frames for supporting opposite ends of a support shaft rotatably mounted on the paper discharge table. The second means comprises vertical and lateral positioning rollers mounted on the support shaft for engaging the clamp boxes.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
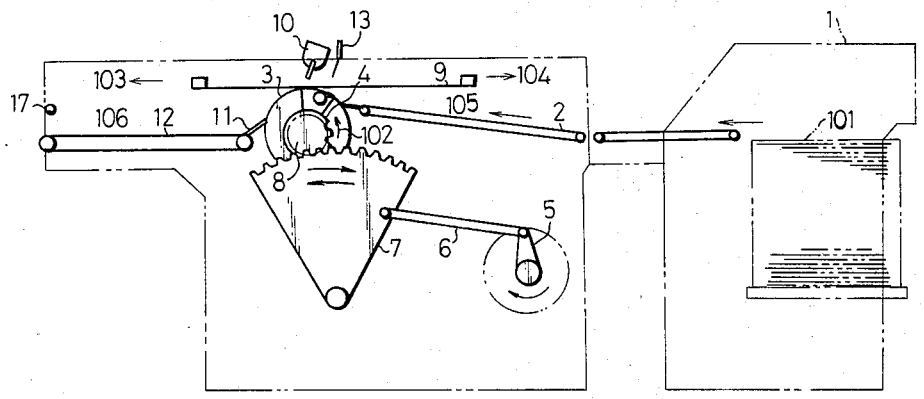
FIG.1 PRIOR ART
FIG. 1 is a schematic front elevational view of a conventional cylinder screen printing machine.
Figure 2:
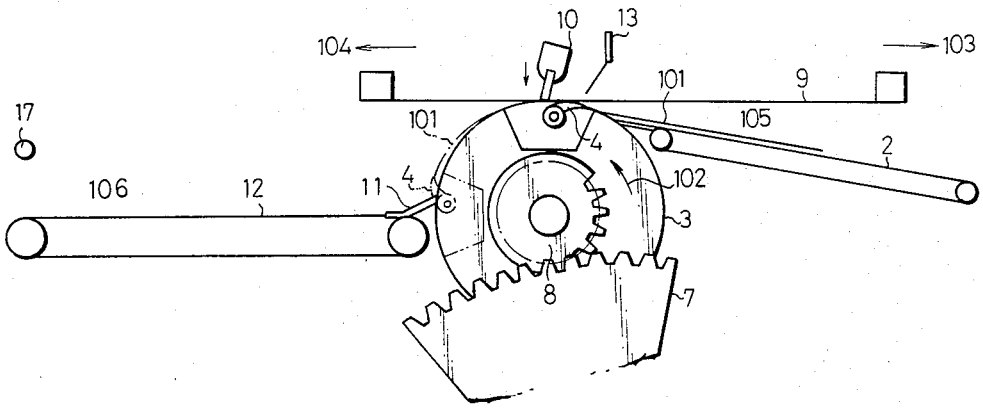
FIG.2 PRIOR ART
FIGS. 2 and 3 are enlarged fragmentary front elevational views showing operations of the cylinder screen printing machine shown in FIG. 1.
Figure 3:
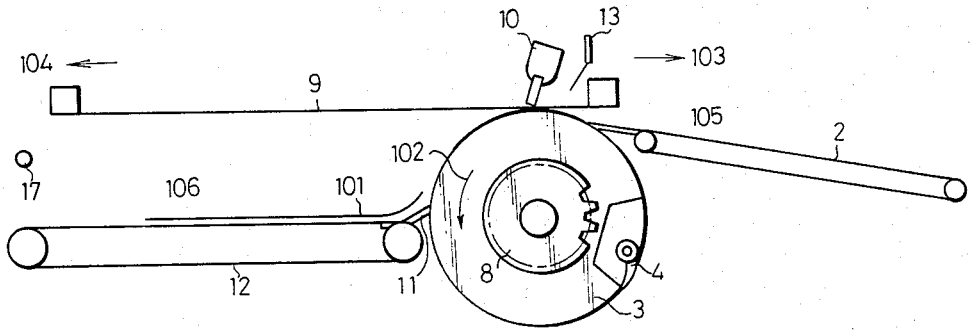
FIG.3 PRIOR ART
Figure 4:
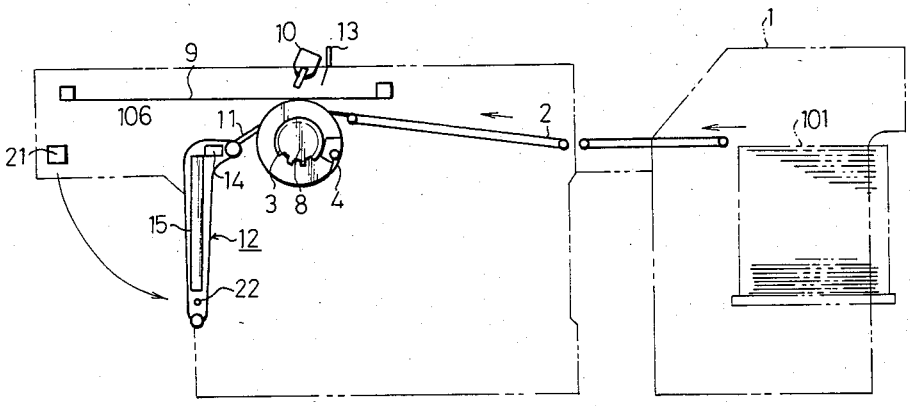
FIG. 4 is a schematic front elevational view of a cylinder screen printing machine incorporating a paper discharger according to the present invention.
Figure 5:
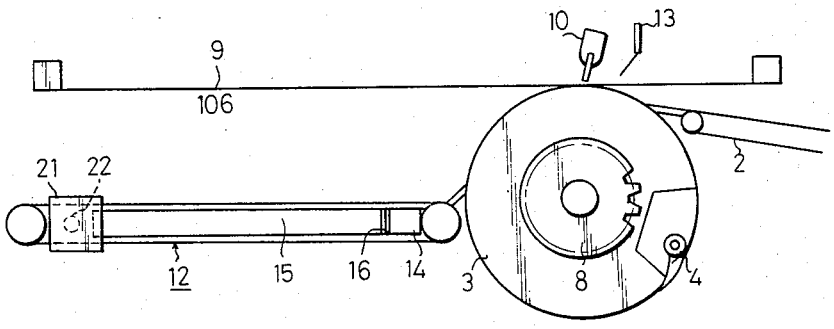
FIG. 5 is an enlarged fragmentary front elevational view of the paper discharger positioned when the printing machine is in operation.
Figure 6:
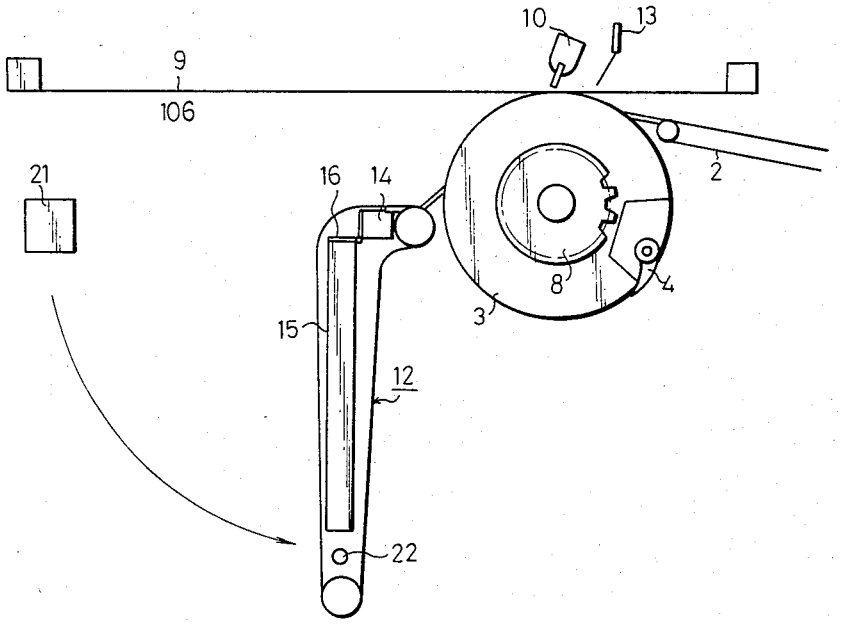
FIG. 6 is an enlarged fragmentary front elevational view of the paper discharger positioned at the time a screen plate is to be cleaned.

The principles of the present invention are particularly useful when embodied in a paper discharger in a cylinder screen printing machine as illustrated in FIGS. 4 through 6. The paper discharger comprises a paper discharge table 12 having a front belt support 14 located closely to a cylinder 3 and a rear belt support 15 pivotably connected to the front belt support 14 by a hinge 16. As illustrated in FIG. 5, when the printing machine is in operation, the rear belt support 15 has a distal end supported by a supporting device composed of a pair of clamp boxes 21. As shown in FIGS. 4 and 6, when the rear belt suport 15 is angularly moved donwardly to a vertical position, there is provided a wide space 106 below a screen plate 9 for easy access of a hand or an instrument to the underside of the screen plate 9. Accordingly, the underside of the screen plate 9 can easily be cleaned, and any dirt can conveniently be removed from the peripheral surface of the cylinder 3. The screen plate 9 and the cylinder 3 can therefore be cleaned at an increase rate of efficiency.

The supporting device for the paper discharge table 12 will be described in greater detail with reference to FIGS. 7 through 16.

Figure 7:
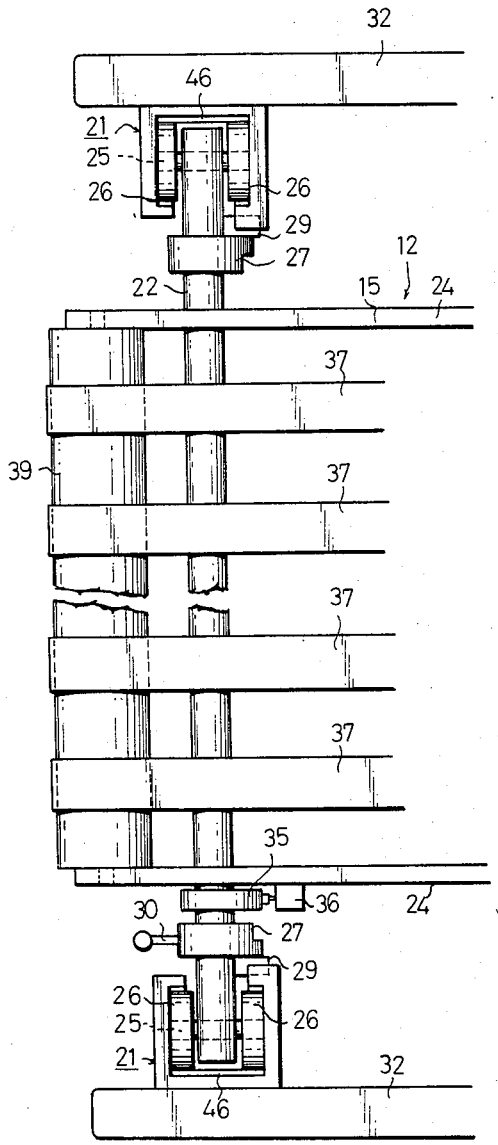
FIG. 7 is an enlarged fragmentary plan view of a supporting device and positioning devices for a paper discharge table.

FIG. 7 shows the rear end of the paper discharge table 12 and the supporting device as seen from above. The rear belt support 5 of the paper discharge table 12 has a pair of lateral frames 24 (shown in upper and lower positions in FIG. 7) with a belt roller 39 rotatably supported between the lateral frames 24 at rear ends thereof. The paper discharge table 12 also includes a plurality of paper discharge belts 37 trained around the belt roller 39.

A support shaft extends laterally through the lateral frames 24 parallel and adjacent to the belt roller 39, and is rotatable about its own axis with respect to the lateral frames 24. The support shaft 22 has a pair of pins 25 extending across and through its opposite end portions. Each of the pins 25 supports a pair of freely rotatable lateral positioning rollers 26 on opposite ends thereof.

Figure 8:
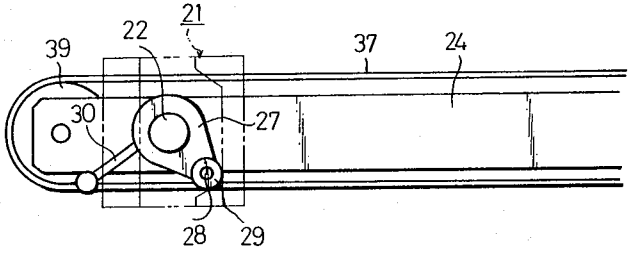
FIG. 8 is an enlarged fragmentary front elevational view of the paper discharge table and a clamp box at the time of upward movement of the paper discharge table.
Figure 13:
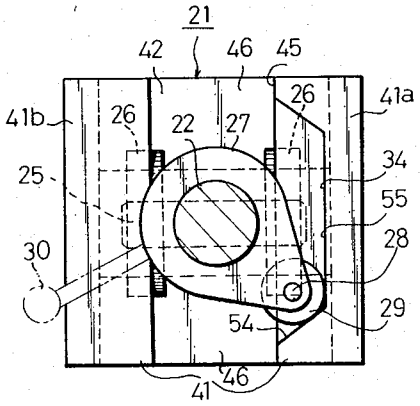
FIG. 13 is an enlarged front elevational view of the clamp box with the vertical positioning roller and the lateral positioning rollers held in engagement therewith.

Swing levers 27 are fixed to the support shaft 22 at positions inward of the positioning rollers 26. As illustrated in FIGS. 8 and 13, each swing lever 27 has a vertical positioning roller 29 rotatably mounted by a shaft 28 on a distal end of the swing lever 27. One of the swing levers 27 has a handle 30 for rotating the support shaft 22 about its own axis.

Figure 9:
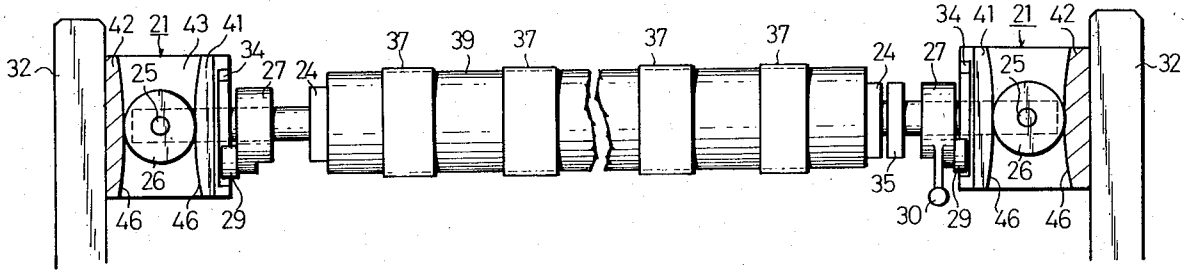
FIG. 9 is an enlarged fragmentary side elevational view of the supporting device and the positioning device for the paper discharge table.

As shown in FIGS. 7 and 9, the clamp boxes 21 (FIG. 10) are secured to inner sides of rear end portions of lateral frames 32 of the printing machine, the clamp boxes 21 being laterally aligned with the ends of the support shaft 22. The pairs of lateral positioning rollers 26 supported on the support shaft 22 are movable from a lower position into the clamp boxes 21, respectively. The rollers 26 and the clamp boxes 21 jointly constitute a positioning device for laterally positioning the rear end portion of the discharge paper table 2.

Figure 10:
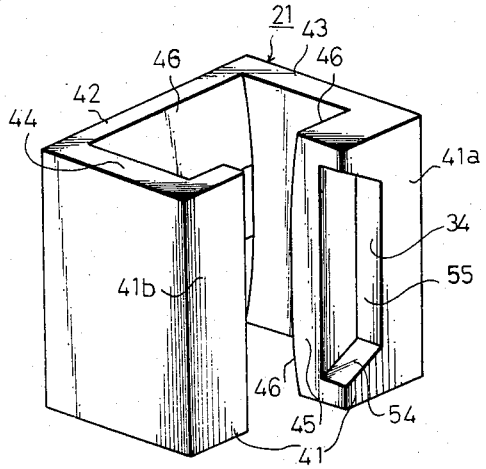
FIG. 10 is an enlarged perspective view of the clamp box.
Figure 11:
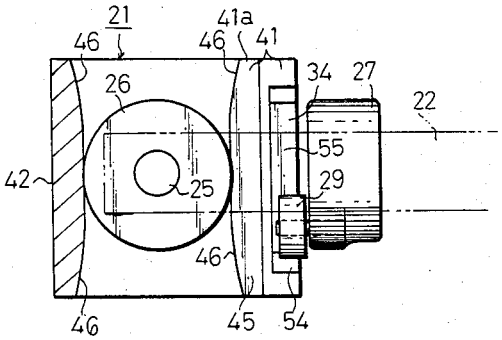
FIG. 11 is an enlarged side elevational view, partly broken away, of the clamp box with a vertical positioning roller and lateral positioning rollers held in engagement therewith.
Figure 12:
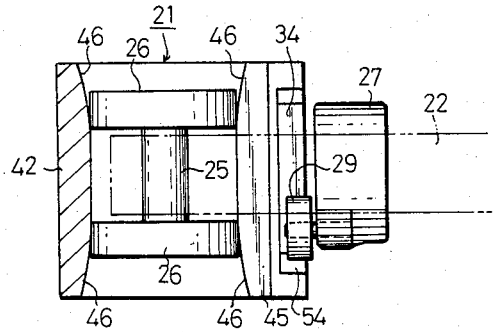
FIG. 12 is an enlarged side elevational view, partly broken away, of the clamp box with the lateral positioning rollers inserted therein from a lower position.

As shown in FIGS. 10 through 12, each of the clamp boxes 21 is substantially in the form of a hollow quadrangular prism having upper and lower open ends, and includes a pair of inner and outer side plates 41, 42 and a pair of front and rear side plates 43, 44. The inner side plate 41 has a vertical insertion slot 45 at a position substantially midway between the front and rear edges thereof. The inner side plate 41 is divided by the slot 45 into front and rear portions 41*a*, 41*b*. The front side plate portion 41*a* has a thickness larger than that of the rear inner plate portion 41*b*. The insertion slot 45 is dimensioned such that the end of the support shaft 22 can be inserted therein from below. The support shaft 22 and the clamp boxes 21 jointly constitute the support device for supporting the paper discharge table 12.

The inner and outer side plates 41, 42 of each clamp box 21 have a plurality of tapered surfaces 46 defined by bevelling upper and lower inner surface portions of the side plates 41, 42. These tapered surfaces 46 serve to allow the lateral positioning rollers 26 to turn easily in the clamp box 21.

The front side plate portion 41*a* of each clamp box 21 has a locking groove 34 for locking therein the vertical positioning roller 29 on the swing lever 27. The locking groove 34 is defined by a slant surface 54 inclined upwardly toward the front edge and serving as a lower edge and a vertical abutment surface 55 extending upwardly from an upper end of the slant surface 54. The locking grooves 34 and the vertical positioning rollers 29 jointly constitute a positioning device for vertically positioning the rear end of the paper discharge table 12.

As shown in FIG. 7, a cam 35 is fixedly mounted on an end portion of the support shaft 22 between the swing lever 27 having the handle 30 and the frame 24 disposed closely to this lever 27. A microswitch 36 is attached to an outer face of the frame 24 in front of the cam 35 for being actuated thereby.

Figure 15:
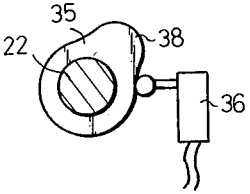
FIG. 15 is a front elevational view of a cam on a support shaft held out of engagement with a microswitch.

When the paper discharge frames 24 are moved upwardly, a lobed projection 38 of the cam 35 is held out of engagement with the microswitch 36, as shown in FIG. 15, at which time the printing machine is capable of operation and the paper discharge table 12 is rendered vertically immovable. When the paper discharge tape 12 is in a lowered position, the lobed projection 38 of the cam 35 is in engagement with the microswitch 36, thereby rendering the printing machine inoperative and making the paper discharge table 12 vertically movable.

Vertical swinging movement of the paper discharge table 12 thus constructed will now be described.

When the printing machine is in operation with the rear belt support 15 held horizontally as shown in FIG. 5, the pairs of lateral positioning rollers 26 on the ends of the support shaft 22 are positioned respectively in the clamp boxes 21 with the pins 25 extending horizontally. At this time, the vertical positioning rollers 29 engage the slant surfaces 54, respectively, of the clamp boxes 21 as illustrated in FIGS. 8 and 13. In addition, the lobed projection 38 of the cam 35 on the support shaft 22 is kept out of engagement with the microswitch 36 as shown in FIG. 15. Consequently, the printing machine is rendered inoperative and the paper discharge table 12 is incapable of vertical movement.

Figure 14:
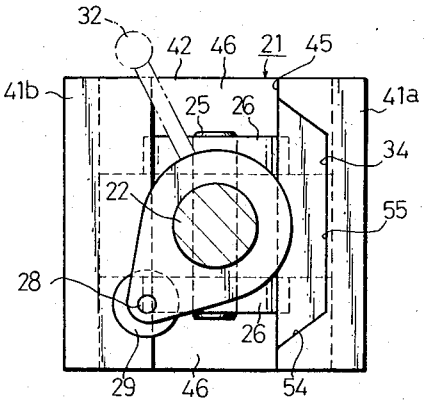
FIG. 14 is an enlarged front elevational view of the clamp box with the lateral positioning rollers inserted therein from the lower position.

For angularly moving the rear belt support 15 downwardly from the position of FIG. 5 to the position of FIG. 6, the handle 30 on the support shaft 22 is turned upwardly through about 90° in FIG. 13. This causes the support shaft 22 and the swing levers 27 to move the vertical positioning rollers 29 backward and downwardly out of engagement with the corresponding slant surfaces 54, as shown in FIG. 14. As the vertical positioning rollers 29 disengage from the slant surfaces 54, the rollers 29 are caused to roll on the slant surfaces 54.

At the same time that the support shaft 22 is turned about its own axis, the pairs of lateral positioning rollers 26 on the ends of the support shaft 22 are angularly moved through about 90° from the position of FIG. 11 to the position of FIG. 12 until the lateral positioning rollers 26 are held substantially horizontally. When the laterally positioning rollers 26 are thus turned by the support shaft 22, opposite circumferential surfaces of the rollers 26 are positioned in confronting but spaced relation to the tapered inner surfaces 46 of the inner and outer side plates 41, 42, allowing the rollers 26 to turn smoothly without being subjected to frictional engagement with the side plates 41, 42.

When the vertical positioning rollers 29 are brought out of engagement with the slant surfaces 54 and the lateral positioning rollers 26 are disposed horizontally, these rollers 29, 26 are disengaged from the clamp boxes 21, whereupon the rear belt support 15 can be turned downwardly.

In the position of FIGS. 12 and 14, the lobed projection of the cam 35 on the support shaft 22 engages the microswitch 36 which then issues a signal to make the printing machine inoperative and the paper discharge table 12 vertically movable.

Figure 16:
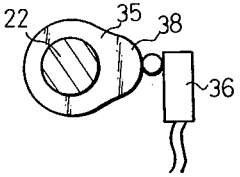
FIG. 16 is a front elevational view of the cam held in engagement with the microswitch.

When it is desired to move the lowered rear belt support 15 back to the position of FIG. 5, the rear end of the rear bent support 15 is lifted to bring the lateral end portions of the support shaft 22 into the insertion slots 45, respectively, in the clamp boxes 21. The pairs of lateral positioning rollers 26 as kept horizontally are also inserted into the clamp boxes 21, respectively, as shown in FIGS. 12 and 14. At this time, the vertical positioning rollers 29 are positioned rearward of the locking grooves 34 in the clamp boxes 21, and the lobed projection 38 of the cam 35 engages the microswitch 36 as shown in FIG. 16.

Then, the handle 30 on the support shaft 22 is angularly moved downwardly to move the vertical positioning rollers 29 into engagement with the slant surfaces 54 of the clamp boxes 21 until front surfaces of the rollers 29 abut against the stop surfaces 55. The support shaft 22 and hence the rear end of the rear belt support 15 are now positioned vertically to a nicety.

When the handle 30 is turned downwardly, the pairs of lateral positioning rollers 26 are also turned through about 90° in the respective clamp boxes 21 as shown in FIGS. 11 and 13. The opposite circumferential surfaces of the rollers 26 are then brought into abutment engagement with the inner surfaces of the inner and outer side plates 41, 42 of the clamp boxes 21. Accordingly, the support shaft 22 and hence the rear end of the rear belt support 15 are now positioned laterally to a nicety.

The lateral positioning rollers 26 can smoothly be turned through 90° in the clamp boxes 21 since the opposite circumferential surfaces of the rollers 26 are initially spaced slightly from the tapered surfaces 46.

With the foregoing arrangement, the rear end of the rear belt support 15 can simply and accurately be positioned vertically and laterally, and reliably be kept in position with respect to the frames 32 without any unwanted wobbling movement. When the paper discharge table 12 is in the lifted position, the frames 32 are interconnected thereby and therefore no fixed shaft stay is required that has conventionally been necessitated to interconnect the frames 32.

Accordingly, the underside of the screen plate can easily be cleaned and any dirt can easily be removed from the peripheral surface of the cylinder when the paper discharge table is lowered downwardly and since there is no shaft stay disposed below the screen plate. The frames of the printing machine can reliably be interconnected by the paper discharge table when it is moved upwardly into the horizontal position. At this time, the rear end of the paper discharge table is positioned laterally and vertically to a nicety.

Although a certain preferred embodiment has been shown and described, it should be understood that many changes and modifications may be made therein without departing from the scope of the appended claims.

What is claimed is:

1. A cylinder screen printing machine comprising:

(a) a cylinder rotatable about its own axis in opposite directions;

(b) a screen plate disposed upwardly of said cylinder and movable reciprocably in synchronism with rotation of said cylinder;

(c) a squeezee positioned upwardly of said screen plate for pressing ink through said screen plate onto a sheet of printing paper passing between said cylinder and said screen plate in response to synchronized movements of said cylinder and said screen plate;

(d) a pair of spaced frames;

(e) a paper discharge table located between said spaced frames and downstream of said cylinder for discharging a printed sheet which has been fed from said cylinder, said paper discharge table being retractable downwardly from an upper position to provide a space below said screen plate;

(f) first means for supporting said paper discharge table in said upper position, said first means being operable to allow said paper discharge table to be retracted downwardly; and (g) second means for positioning a rear end of said paper discharge table vertically and laterally in said upper position with respect to said pair of frames.

2. A cylinder screen printing machine according to claim 1, wherein said first means comprises a support shaft rotatably supported on said paper discharge table and having opposite ends projecting laterally from lateral sides of said paper discharge table, and a pair of clamp boxes secured to inner sides of said spaced frames for releasably supporting said opposite ends of said support shaft.

3. A cylinder screen printing machine according to claim 2, wherein each of said clamp boxes is substantially in the form of a hollow quadrangular prism having upper and lower open ends and comprising a pair of inner and outer side plates and a pair of front and rear side plates, said inner side plate having a insertion slot for insertion therein of one of the opposite ends of said support shaft.

4. A cylinder screen printing machine according to claim 3, wherein said inner side plates of said clamp boxes have locking grooves, said second means comprising two pairs of lateral positioning rollers rotatably mounted on the ends of said support shaft and insertable into said clamp boxes, respectively, and a pair of vertical positioning rollers mounted on said support shaft inwardly of said lateral positioning rollers and engageable respectively in said locking grooves.

5. A cylinder screen printing machine according to claim 4, wherein each of said locking grooves is defined by a slant surface with which one of said vertical positioning rollers is engageable and a stop surface extending from said slant surface for abutment engagement with said vertical positioning roller.

6. A cylinder screen printing machine according to claim 4, including a pair of pins extending through said support shaft and a pair of swing levers mounted on said support shaft, said pairs of lateral positioning rollers being rotatably mounted on ends of said pins, respectively, said pair of vertical positioning rollers being rotatably mounted by shafts on distal ends of said swing levers, respectively.

7. A cylinder screen printing machine according to claim 6, wherein, when said paper discharge table is in said upper position, said pairs of lateral positioning rollers are disposed in said clamp boxes, respectively, in horizontal alignment while engaging said inner and outer side plates of said clamp boxes, respectively, and said vertical positioning rollers engage respectively in said locking grooves in said inner side plates.

8. A cylinder screen printing machine according to claim 7, including a handle attached to one of said swing levers for anularly moving said support shaft about its own axis to enable said vertical positioning rollers to engage in and disengage from said locking grooves and said lateral positioning rollers to turn in said clamp boxes.

9. A cylinder screen printing machine according to claim 8, wherein said inner and outer side plates of each of said clamp boxes have inner tapered surfaces spaced from said lateral positioning rollers for allowing the latter to turn easily in said clamp boxes, when said lateral positioning rollers are disposed in said clamp boxes.

10. A cylinder screen printing machine according to claim 8, including a cam mounted on said support shaft and a microswitch mounted on said paper discharge table and actuatable by said cam to disable the printing machine and allow said paper discharge table to move vertically when said support shaft is turned about its own axis.

* * * * *